US010932083B2

(12) United States Patent
Brimijoin, II et al.

(10) Patent No.: US 10,932,083 B2
(45) Date of Patent: Feb. 23, 2021

(54) INDIVIDUALIZATION OF HEAD RELATED TRANSFER FUNCTION TEMPLATES FOR PRESENTATION OF AUDIO CONTENT

(71) Applicant: Facebook Technologies, LLC, Menlo Park, CA (US)

(72) Inventors: William Owen Brimijoin, II, Kirkland, WA (US); Henrik Gert Hassager, Redmond, WA (US); Vamsi Krishna Ithapu, Kirkland, WA (US); Philip Robinson, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/387,897

(22) Filed: Apr. 18, 2019

(65) Prior Publication Data

US 2020/0336858 A1 Oct. 22, 2020

(51) Int. Cl.

| | |
|---|---|
| ***H04R 5/02*** | (2006.01) |
| ***H04S 7/00*** | (2006.01) |
| ***H04R 5/033*** | (2006.01) |
| ***H04S 3/00*** | (2006.01) |
| ***H04R 5/04*** | (2006.01) |

(52) U.S. Cl.

CPC ..... *H04S 7/304* (2013.01); *H04R 5/033* (2013.01); *H04R 5/04* (2013.01); *H04S 3/008* (2013.01); *H04S 2400/11* (2013.01); *H04S 2420/01* (2013.01)

(58) Field of Classification Search

CPC ..... H04S 7/304; H04S 3/008; H04S 2400/11; H04S 2420/01; H04R 5/033; H04R 5/04

USPC ..... 381/303, 310

See application file for complete search history.

(56) References Cited

U.S. PATENT DOCUMENTS

| | | | | |
|---|---|---|---|---|
| 6,996,244 | B1 * | 2/2006 | Slaney | H04S 1/002 381/303 |
| 2001/0040968 | A1 | 11/2001 | Mukojima | |
| 2007/0092085 | A1 | 4/2007 | Katayama et al. | |
| 2010/0303267 | A1 * | 12/2010 | Pedersen | H04R 25/407 381/313 |
| 2015/0312694 | A1 | 10/2015 | Bilinski et al. | |
| 2016/0345095 | A1 * | 11/2016 | Gamper | H04R 5/0335 |
| 2018/0249274 | A1 * | 8/2018 | Lyren | H04S 7/303 |
| 2019/0014431 | A1 * | 1/2019 | Lee | H04R 5/04 |

(Continued)

FOREIGN PATENT DOCUMENTS

WO WO 2017/097324 A1 6/2017

OTHER PUBLICATIONS

PCT International Search Report and Written Opinion, PCT Application No. PCT/US2020/027626, dated Jun. 29, 2020, 12 pages.

*Primary Examiner* — Ammar T Hamid
(74) *Attorney, Agent, or Firm* — Fenwick & West LLP

(57) ABSTRACT

A system for generating individualized HRTFs that are customized to a user of a headset. The system includes a server and an audio system. The server determines the individualized HRTFs based in part on acoustic features data (e.g., image data, anthropometric features, etc.) of the user and a template HRTF. The server provides the individualized HRTFs to the audio system. The audio system presents spatialized audio content to the user using the individualized HRTFs.

20 Claims, 9 Drawing Sheets
(1 of 9 Drawing Sheet(s) Filed in Color)

(56) References Cited

U.S. PATENT DOCUMENTS

| | | | | |
|---|---|---|---|---|
| 2019/0020963 | A1* | 1/2019 | Mor | H04S 3/008 |
| 2020/0068337 | A1* | 2/2020 | Murata | H04S 7/307 |

* cited by examiner

INDIVIDUALIZATION OF HEAD RELATED TRANSFER FUNCTION TEMPLATES FOR PRESENTATION OF AUDIO CONTENT

BACKGROUND

The present disclosure generally relates to binaural audio synthesis, and specifically to individualizing head-related transfer functions (HRTFs) for presentation of audio content.

A sound from a given source received at two ears can be different, depending on a direction and location of the sound source with respect to each ear as well as on the surroundings of the room in which the sound is perceived. A HRTF characterizes sound received at an ear of the person for a particular location (and frequency) of the sound source. A plurality of HRTFs are used to characterize how a user perceives sound. In some instances, the plurality of HRTFs form a high dimensional data set that depends on tens of thousands of parameters to provide a listener with a percept of sound source direction.

SUMMARY

A system for generating individualized HRTFs that are customized to a user of an audio system (e.g., may be implemented as part of a headset). The system includes a server and an audio system. The server determines the individualized HRTFs based in part on acoustic features data (e.g., image data, anthropometric features, etc.) of the user and a template HRTF. A template HRTF is an HRTF that can be customized (e.g., add one or more notches) such that it can be individualized to different users. The server provides the individualized HRTFs to the audio system. The audio system presents spatialized audio content to the user using the individualized HRTFs. Methods described herein may also be embodied as instructions stored on computer readable mediums.

In some embodiments, a method is disclosed for execution by a server. The method comprises determining one or more individualized filters (e.g., e.g., via machine learning) based at least in part on acoustic features data of a user. One or more individualized HRTFs for the user are generated based on a template HRTF and the one or more individualized filters. The one or more individualized filters function to individualize (e.g., add one or more notches) the template HRTF such that it is customized to the user, thereby forming an individualized HRTF. The server provides the generated one or more individualized HRTFs to an audio system, wherein an individualized HRTF is used to generate spatialized audio content.

In some embodiments, a method is disclosed for execution by a headset. The method comprises receiving (e.g., from a server), at a headset, one or more individualized HRTFs for a user of the headset. The headset retrieves audio data associated with a target sound source direction with respect to the headset. The headset applies the one or more individualized HRTFs to the audio data to render the audio data as audio content. The headset presents, by a speaker assembly, the audio content, wherein the presented audio content is spatialized such that it appears to be originating from the target sound source direction.

Figure 1:
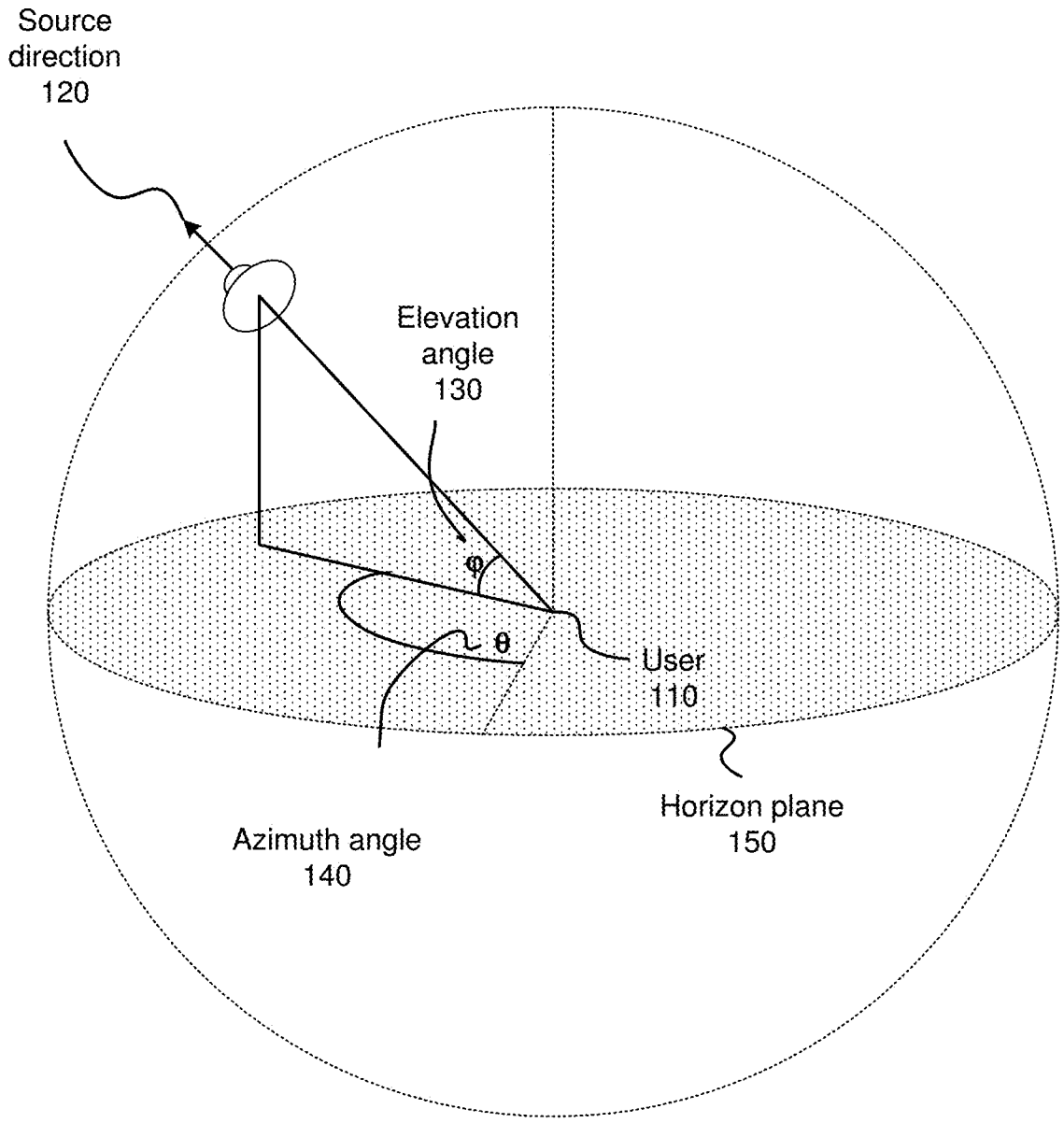
FIG. 1 is a perspective view of sound source elevation from a user's viewpoint, in accordance with one or more embodiments.

The figures depict various embodiments of the present invention for purposes of illustration only. One skilled in the art will readily recognize from the following discussion that alternative embodiments of the structures and methods illustrated herein may be employed without departing from the principles of the invention described herein.

The patent or application file contains at least one drawing executed in color. Copies of this patent or patent application publication with color drawing(s) will be provided by the Office upon request and payment of the necessary fee.

DETAILED DESCRIPTION

Overview

A system environment configured to generate individualized HRTFs. A HRTF characterizes sound received at an ear of the person for a particular location of the sound source. A plurality of HRTFs are used to characterize how a user perceives sound. The HRTFs for a particular source direction relative to a person may be unique to the person based on the person's anatomy (e.g., ear shape, shoulders, etc.), as their anatomy affects how sound arrives at the person's ear canal.

A typical HRTF that is specific to a user includes features (e.g., notches) that act to customize the HRTF for the user. A template HRTF is an HRTF that was determined using data from some population of people, and that can then be individualized to be specific to a single user. Accordingly, a single template HRTF is customizable to provide different individualized HRTFs for different users. The template HRTF may be considered a smoothly varying continuous energy function with no individual sound source directional frequency characteristics over one or more frequency ranges (e.g., 5 kHz-10 kHz). An individualized HRTF is generated using the template HRTF by applying one or more filters to the template HRTF. For example, the filters may act to introducing one or more notches into the template HRTF. In some embodiments, for a given source direction, a notch is described by the following parameters: a frequency location, a width of a frequency band centered around the frequency location, and a value of attenuation in the frequency band at the frequency location. A notch may be viewed as the result of the resonances in the acoustic energy as it arrives at the head of a listener and bounces around the head and pinna undergoing cancellations before reaching the entrance of the ear canal. As noted above, notches can affect how a person perceives sound (e.g., from what elevation relative to the user a sound appears to originate).

The system environment includes a server and an audio system (that may be fully or partially implemented as part of a headset, may be separate and external to the headset, etc.). The server may receive acoustic features data describing features of a head of a user and/or the headset. For example, the user may provide images and/or video of their head and/or ears, anthropometric features of the head and/or ears, etc. to the server system. The server determines parameter values for one or more individualized filters (e.g., add notches) based at least in part on the acoustic features data. For example, the server may utilize machine learning to identify parameter values for the one or more notch filters based on the received acoustic features data. The server generates one or more individualized HRTFs for the user based on the template HRTF and the individualized filters (e.g., determined parameter values for the one or more individualized notches). In some embodiments, the server provides the one or more individualized HRTFs to an audio system (e.g., may be part of a headset) associated with the user. The audio system may apply the one or more individualized HRTFs to audio data to render the audio data as audio content. The audio system may then present (e.g., via a speaker assembly of the audio system), the audio content. The presented audio content is spatialized audio content (i.e., appears to be originating from one or more target sound source directions).

In some embodiments, some or all of the functionality of the server is performed by the audio system. For example, the server may provide the individualized filters (e.g., parameter values for the one or more individualized notches) to the audio system on the headset, and the audio system may generate the one or more individualized HRTFs using the individualized filters and a template HRTF.

FIG. 1 is a perspective view of a user's 110 hearing perception in perceiving audio content, in accordance with one or more embodiments. An audio system (not shown) presents audio content to the user 110 of the audio system. In this illustrative example, the user 110 is placed at an origin of a spherical coordinate system, more specifically a midpoint between the user's 110 ears. When the audio system in a headset provides audio content to the user 110, to facilitate an immersive experience for the user, the audio system can spatially localize audio content such that a user perceives as the audio content as originating from a source direction 120 with respect to the headset. The source direction 120 may be described by an elevation angle φ 130 and an azimuthal angle θ 140. The elevation angles are angles measured from the horizon plane 150 towards a pole of the spherical coordinate system. The azimuthal angles are measured in the horizon plane 150 from a reference axis. In other embodiments, a perceived sound origination direction may include one or more vectors, e.g., an angle of vectors describing a width of perceived sound origination direction or a solid angle of vectors describing an area of perceived sound origination direction. Audio content may be further spatially localized as originating at a particular distance in the target sound source direction using the physical principle that acoustic pressure decreases with the ratio 1/r with distance r.

Two of the parameters that affect sound localization are the interaural time differences (ITD) and interaural level differences (ILD) of a user. The ITD describes the difference in arrival time of a sound between the two ears, and this parameter provides a cue to the angle or direction of the sound source from the head. For example, sound from the source located at the right side of the person will reach the right ear before it reaches the left ear of the person. The ILD describes the difference in the level or intensity of the sound between the two ears. For example, sound from the source located at the right side of the person will be louder as heard by the right ear of the person compared to sound as heard by the left ear due to the head occluding part of the sound waves as it travels to the left ear. ITDs and ILDs may affect lateralization of sound.

In some embodiments the individualized HRTFs for a user are parameterized based on the sound source elevation and azimuthal angles. Thus, for a target user audio perception of a particular source direction 120 with defined values for elevation angle φ 130 and an azimuthal angle θ 140, the audio content provided to the user may be modified by a set of HRTFs individualized for the user and also for the target source direction 120. Some embodiments may further spatially localize the presented audio content for a target distance in the target sound source direction as a function of distance between the user 110 and a target location that the sound is meant to be perceived as originating from.

Template HRTFs

A template HRTF is an HRTF that can be customized such that it can be individualized to different users. The template HRTF may be considered a smoothly varying continuous energy function with no individual sound source directional frequency characteristics, but describing the average sound source directional frequency characteristics for a group of listeners (e.g., in some cases all listeners).

In some embodiments, a template HRTF is generated from a generic HRTF over a population of users. In some embodiments, a generic HRTF corresponds to an average HRTF that is obtained over a population of users. In some embodiments, a generic HRTF corresponds to one of the HRTFs from a database of HRTFs obtained from a population of users. The criteria for selection of this one HRTF from the database of HRTFs, in some embodiments, corresponds to a predefined machine learning or statistical model or a statistical metric. The generic HRTF exhibits average frequency characteristics for varying sound source directions over the population of users.

In some embodiments, the template HRTF can be considered to retain mean angle-dependent ITDs and ILDs for a general population of users. However, the template HRTF does not exhibit any individualized frequency characteristics (e.g., notches in specific locations). A notch may be viewed as the result of the resonances in the acoustic energy as it arrives at the head of a listener and bounces around the head and pinna undergoing cancellations before reaching the entrance of the ear canal. Notches (e.g., the number of notches, the location of notches, width of notches, etc.) in an HRTF act to customize/individualize that HRTF for a particular user. Thus, the template HRTF is a generic non-individualized parameterized frequency transfer function that has been modified to remove individualized notches in the frequency spectrum, particularly those between 5 kHz and 10 kHz. And in some embodiments, these notches may be located below 5 kHz and above 10 kHz.

A fully individualized "true" HRTF for a user is a high dimensional data set depending on tens of thousands of parameters to provide a listener with a realistic sound source elevation perception. Features such as the geometry of the user's head, shape of the pinnae of the ear, geometry of the ear canal, density of the head, environmental characteristics, all transform the audio content as it travels from the source location, and influence how audio is perceived by the individual user (e.g., attenuating or amplifying frequencies of the generated audio content). In short, individualized 'true' HRTFs for a user includes individualized notches in the frequency spectrum.

Figure 2:
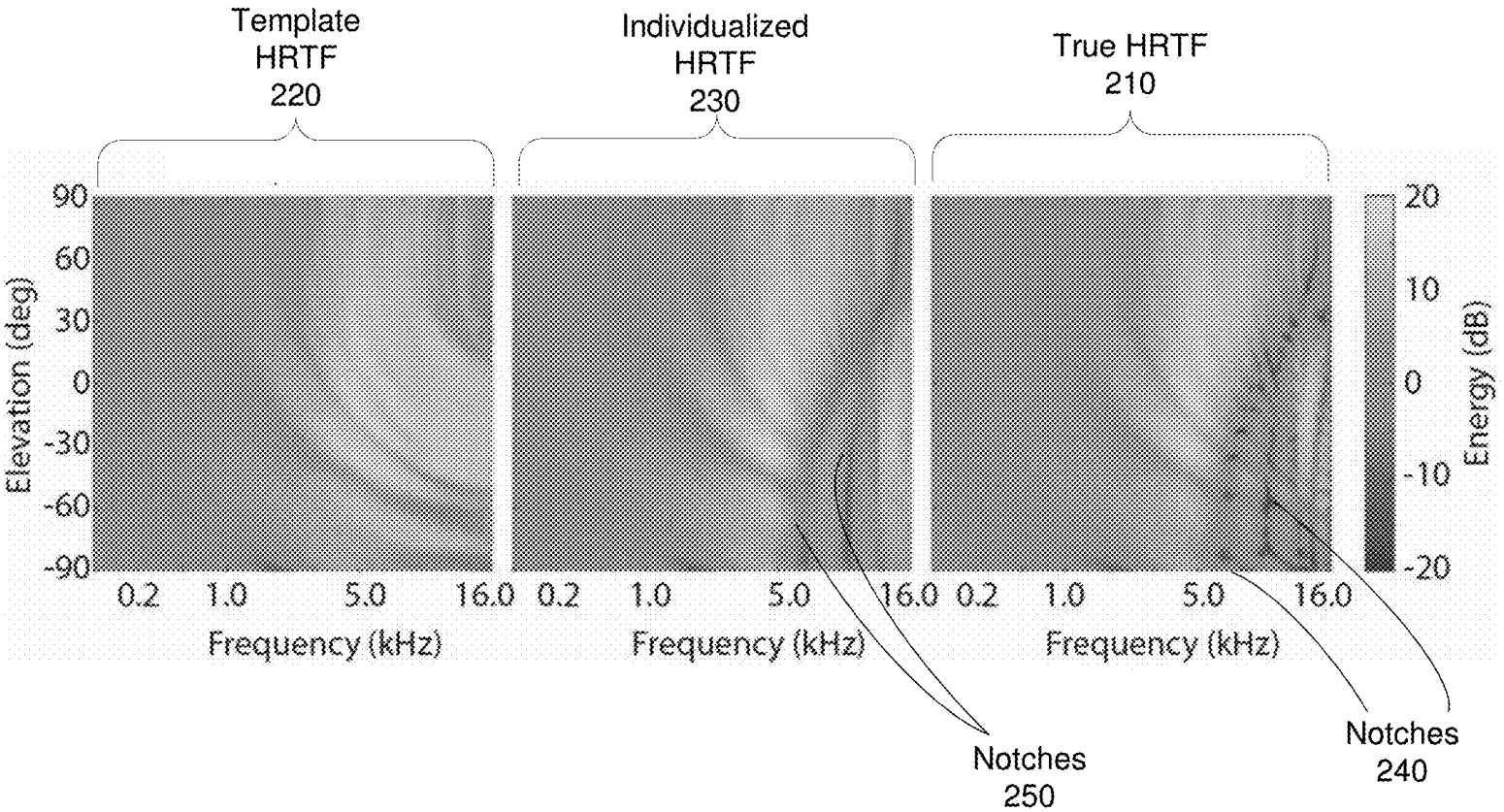
FIG. 2 illustrates an example depiction of three HRTFs as parameterized by sound source elevation for a user, in accordance with one or more embodiments.

FIG. 2 illustrates an example depiction of three HRTFs as parameterized by sound source elevation for a user, in accordance with one or more embodiments. The three HRTFs include a true HRTF 210 for a user, a template HRTF 220, and an individualized HRTF 230. These three HRTFs depict the color-scale coded energy value in decibels, energy (dB) over a range of −20 dB-20 dB, as parameterized over a set of frequency values in kilohertz, frequency (kHz) over a range of 0.0 kHz-16.0 kHz, for elevation angles in degrees, elevation (deg) over a range of −90-90 deg., and are further discussed below. Note while not shown, there would also be plots for each of these HRTFs as a function of azimuth.

The true HRTF 210 describes the true frequency attenuation characteristics that impact how an ear receives a sound from a point in space, across illustrated elevation range. Note that at a frequency range of approximately 5.0 kHz-16.0 kHz, the true HRTF 330 exhibits frequency attenuation characteristics over the range of elevations. This is depicted visually as notches 240. This means that, for with respect to audio content within a frequency band range of 5.0 kHz-16 kHz, in order for audio content to provide the user with a true immersive experience with respect to sound source elevation, the generated audio content may ideally be convolved with an HRTF that is as close as possible to the true HRTF 210 for the illustrated elevation ranges.

The template HRTF 220 represents an example of frequency attenuation characteristics displayed by a generic centroid HRTF that retains mean angle-dependent ITDs and ILDs for a general population of users. Note that the template HRTF 220 exhibits similar characteristics to the true HRTF 210 at a frequency range of approximately 0.0 kHz-5.0 kHz. However, at a frequency range of approximately 5.0 kHz-16.0 kHz, unlike the true HRTF 330, the template HRTF 220 exhibits diminished frequency attenuation characteristics across the illustrated range of elevations.

The individualized HRTF 230 is a version of the template HRTF 220 that has been individualized for the user. As discussed below with regard to FIGS. 3-7, the individualization applies one or more filters to the template HRTF. The one or more filters may act to introduce one or more notches into the template HRTF. In the illustrated example, two notches 350 are added to the HRTF template 230 to form the individualized HRTF 230. Note that the individualized HRTF 230 exhibits similar characteristics to the true HRTF 210 at frequency ranges from 0.0 kHz-16.0 kHz, due in part to the notches 250 approximating the notches 240 in the true HRTF 210.

System Overview

Figure 3:
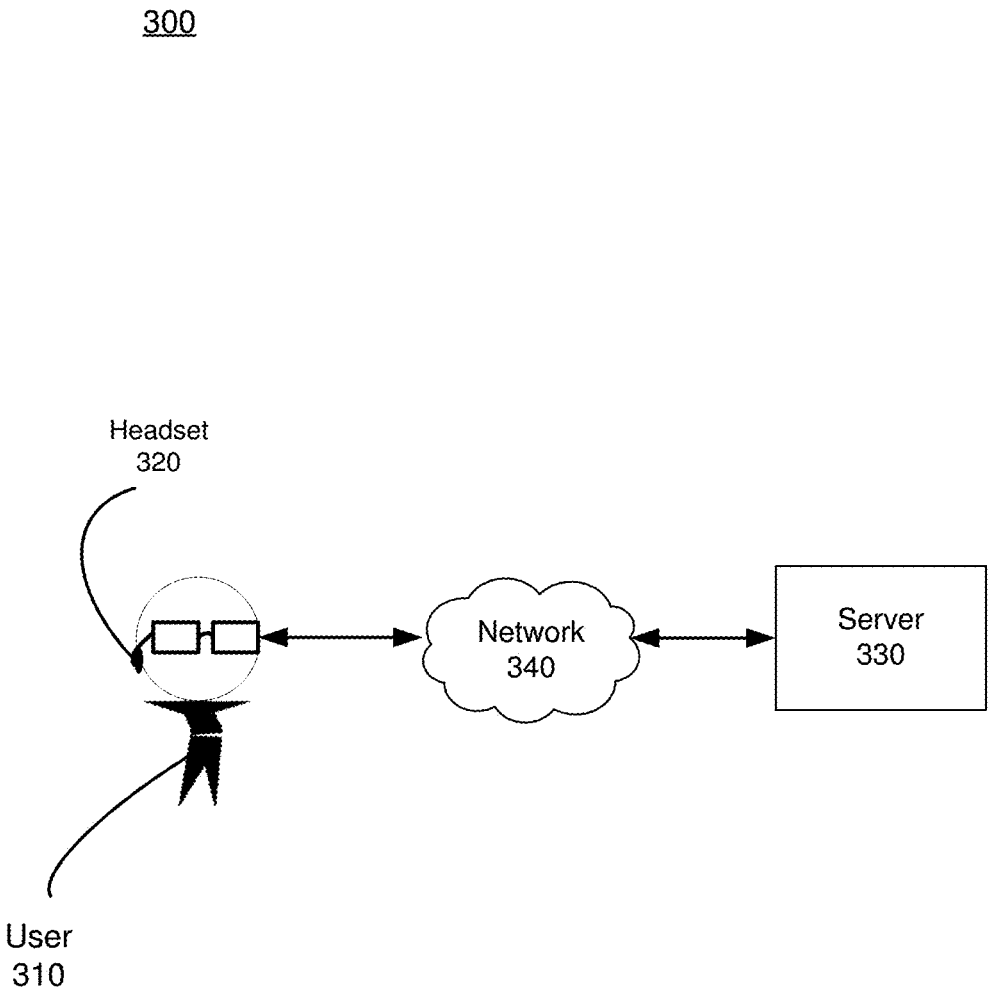
FIG. 3 is a schematic diagram of a high-level system environment for generating individualized HRTFs, in accordance with one or more embodiments.

FIG. 3 is a schematic diagram of a high-level system environment 300 for determining an individualized HRTF for a user 310, in accordance with one or more embodiments. A headset 320 communicates with a server 330 through a network 340. The headset 320 may be worn by the user 310.

The server 330 receives acoustic feature data. For example, the user 310 may provide the acoustic features data to the server 330 via the network 340. Acoustic features data describes features of a head of the user 310 and/or the headset 320. Acoustic features data may include, for example, one or more images of a head and/or ears of the user 310, one or more videos of the head and/or ears of the user 310, anthropometric features of the head and/or ears of the user 310, one or more images of the head wearing the headset 320, one or more images of the headset 320 in isolation, one or more videos of the head wearing the headset 320, one or more videos of the headset 320 in isolation, or some combination thereof. Anthropometric features of the user 310 are measurements of the head and/or ears of the user 310. In some embodiments, the anthropometric features may be measured using measuring instruments like a measuring tape and/or ruler. In some embodiments, images and/or videos of the head and/or ears of the user 310 are captured using an imaging device (not shown). The imaging device may be a camera on the headset 320, a depth camera assembly (DCA) that is part of the headset 320, an external camera (e.g., part of a mobile device), an external DCA, some other device configured to capture images and/or depth information, or some combination thereof. In some embodiments, the imaging device is also used to capture images of the headset 320. The data may be provided through the network 340 to the server 330.

To capture the user's head more accurately, the user 310 (or some other party) positions an imaging device in in different positions relative to their head, such that the captured images cover different portions of the head of the user 310. The user 310 may hold the imaging device at different angles and/or distances relative to the user 310. For example, the user 310 may hold the imaging device at arm's length directly in front of the user's 310 face and use the imaging device to capture images of the user's 310 face. The user 310 may also hold the imaging device at a distance shorter than arm's length with the imaging device pointed towards the side of the head of the user 310 to capture an image of the ear and/or shoulder of the user 310. In some embodiments, the imaging device may run a feature recognition software and capture an image automatically when features of interest (e.g., ear, shoulder) are recognized or receive an input from the user to capture the image. In some embodiments, the imaging device may have an application that has a graphical user interface (GUI) that guides the user 310 to capture the plurality of images of the head of the user 310 from specific angles and/or distances relative to the user 310. For example, the GUI may request a front-facing image of a face of the user 310, an image of a right ear of the user 310, and an image of left ear of the user 310. In some embodiments, anthropometric features are determined by the imaging device using the images and/or videos captured by the imaging device.

In the illustrated example, the data is provided from the headset 320 via the network 340 to the server 330. However, in alternate embodiments, some other device (e.g., a mobile device (e.g., smartphone, tablet, etc.), a desktop computer, an external camera, etc.) may be used to upload the data to the server 330. In some embodiments, the data may be directly provided to the server 330.

The network 340 may be any suitable communications network for data transmission. The network 340 is typically the Internet, but may be any network, including but not limited to a Local Area Network (LAN), a Metropolitan Area Network (MAN), a Wide Area Network (WAN), a mobile wired or wireless network, a private network, or a virtual private network. In some example embodiments, network 340 is the Internet and uses standard communications technologies and/or protocols. Thus, network 340 can include links using technologies such as Ethernet, 802.11, worldwide interoperability for microwave access (WiMAX), 3G, 4G, digital subscriber line (DSL), asynchronous transfer mode (ATM), InfiniBand, PCI express Advanced Switching, etc. In some example embodiments, the entities use custom and/or dedicated data communications technologies instead of, or in addition to, the ones described above.

The server 330 uses the acoustic features data of the user along with a template HRTF to generate individualized HRTFs for the user 310. In some embodiments, there is a single template HRTF for all users. However, in alternate embodiments, there are a plurality of different template HRTFs, and each template HRTF is directed to different groups that have one or more common characteristics (e.g., head size, ear shape, men, women, etc.). In some embodiments, each template HRTF is associated with specific characteristics. The characteristics may be, e.g., head size, head shape, ear size, gender, age, some other characteristic that affects how a person perceives sound, or some combination thereof. For example, there may be different HRTFs based on variation in head size and/or age (e.g., there may be a template HRTF for children and a different HRTF for adults) as ITD may scale with head diameter. In some embodiments, the server 330 uses the acoustic features data to determine one or more characteristics (e.g., ear size, shape, head size, etc.) that describe the head of the user 310. The server 330 may then select a template HRTF based on the one or more characteristics.

The server 330 uses a trained machine learning system on the acoustic features data to obtain filters that are customized to the user. The filters can be applied to a template HRTF to create an individualized HRTF. A filter may be, e.g., a band pass (e.g., describes a peak), a band stop (e.g., describes a notch), a high pass (e.g., describes a high frequency shelf), a low pass (e.g., e.g., describes a low frequency shelf), or some combination thereof. A filter may be described by one or more parameter values. Parameter values may include, e.g., a frequency location, a width of a frequency band centered around the frequency location (e.g., determined by a Quality factor and/or Filter Order), and depth at the frequency location (e.g., gain). Depth at the frequency location refers to a value of attenuation in the frequency band at the frequency location. A single filter or combinations of filters may be used to describe one or more notches. In some embodiments, the server 330 uses a trained machine learning (ML) model to determine filter parameter values for one or more individualized filters using the acoustic features data of the user 310. The ML model may determine the filters based in part on ITDs and/or ILDs that are estimated from the acoustic features data. As noted above ITDs may affect, e.g., elevation, and ILDs can have some affect regarding lateralization. The one or more individualized filters are each applied to the template HRTF based on the corresponding filter parameter values to modify the template HRTF (e.g., adding one or more notches), thereby generating individualized HRTFs (e.g., at least one for each ear) for the user 310. The individualized HRTFs may be parameterized by elevation and azimuth angles. In some embodiments, when multiple users may operate the headset 320, the ML model may determine parameter values for individualized notches to be applied to the template HRTF for each particular individual user to generate individualized HRTFs for each of the multiple users.

In some embodiments, the server 330 provides the individualized HRTFs to the headset 320 via the network 340. The audio system (not shown) in the headset 320 stores the individualized HRTFs. The headset 320 may then use the individualized HRTFs to render audio content to the user 310 such that it would appear to originate from a specific location towards the user (e.g., in front of, behind, from a virtual object in the room, etc.). For example, the headset 320 may convolve audio data with one or more individualized HRTFs to generate spatialized audio content, that when presented, appears to originate from the specific location (i.e., spatialized audio content).

In some embodiments, the server 330 provides the generated individualized sets of filter parameter values to the headset 310. In this embodiment, the audio system (not shown) in the headset 320 applies the individualized sets of filter parameter values to a template HRTF to generate one or more individualized HRTFs. The template HRTF may be stored locally on the headset 320 and/or retrieved from some other location (e.g., the server 330).

Figure 4:
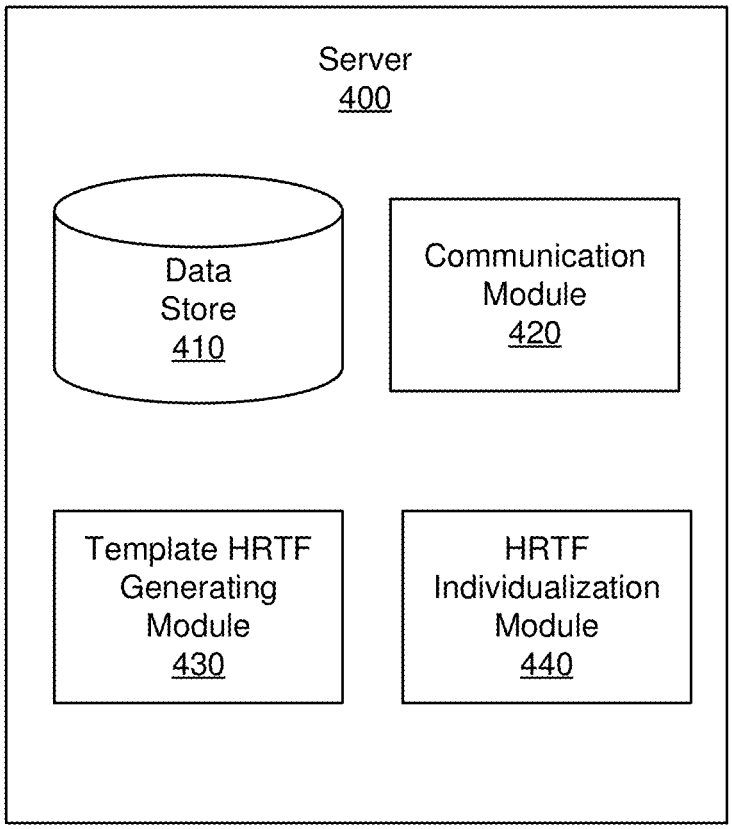
FIG. 4 is a block diagram of a server, in accordance with one or more embodiments.

FIG. 4 is a block diagram of a server 400, in accordance with one or more embodiments. The server 330 is an embodiment of the server 400. The server 400 includes various components, including, e.g., a data store 410, a communication module 420, a template HRTF generating module 430, and an HRTF individualization module 440. Some embodiments of the server 400 have different components than those described here. Similarly, the functions can be distributed among the components in a different manner than is described here. And in some embodiments, one or more functions of the server 400 may be performed by other components (e.g., an audio system of a headset).

The data store 410 stores data for use by the server 400. Data in the data store 410 may include, e.g., one or more template HRTFs, one or more individualized HRTFs, individualized filters (e.g., individualized sets of filter parameter values), user profiles, acoustic features data, other data relevant for use by the server system 400, audio data, or some combination thereof. In some embodiments, the data store 410 stores one or more template HRTFs from the template HRTF generating module 430, stores individualized HRTFs from the HRTF individualization module 440, stores individualized sets of filter parameter values from the HRTF individualization module 440, or some combination thereof. In some embodiments, the data store 410 may periodically receive and store updated time-stamped template HRTFs from the template HRTF generating module 440. In some embodiments, periodically updated individualized HRTFs for the user may be received from the HRTF individualization module 440, time-stamped, and stored in the data store 410. In some embodiments, the data store 410 may receive and store time-stamped individualized sets of filter parameter values from the HRTF individualization module 440.

The communication module 420 communicates with one or more headsets (e.g., the headset 320). In some embodiments, the communications module 420 may also communicate with one or more other devices (e.g., an imaging device, a smartphone, etc.). The communication module 420 may communicate via, e.g., the network 340 and/or some direct coupling (e.g., Universal Serial Bus (USB), WIFI, etc.). The communication module 420 may receive a request from a headset for individualized HRTFs for a particular user, acoustic features data (from the headset and/or some other device), or some combination thereof. The communication module 420 may also provide one or more individualized HRTFs, one or more individualized sets of filter parameter values, one or more template HRTFs, or some combination thereof, to a headset.

The template HRTF generating module 430 generates a template HRTF. The generated template HRTF may be stored in the data store 410, and may also be sent to a headset for storage at the headset. In some embodiments, the HRTF generating module 430 generates a template HRTF from a generic HRTF. The generic HRTF is associated with some population of users and may include one or more notches. A notch in the generic HRTF corresponds to a change in this amplitude over a frequency window or band. A notch is described by the following parameters: a frequency location, a width of a frequency band centered around the frequency location, and a value of attenuation in the frequency band at the frequency location. In some embodiments, a notch in an HRTF is identified as the location of frequency where the change in amplitude of above a predefined threshold. Accordingly, notches in a generic HRTF can be thought to represent average attenuation characteristics as a function of frequency and direction for the population of users.

The template HRTF generating module 430 removes notches in the generic HRTF over some or all of an entire audible frequency band (range of sounds that humans can perceive) to form a template HRTF. The template HRTF generating module 430 may also smooth the template HRTF such that some or all of it is a smooth and continuous function. In some embodiments, the template HRTF is generated to be a smooth and continuous function lacking notches over some frequency ranges, but not necessarily lacking notches outside of those frequency ranges. In some embodiments, the template HRTF is such that there are no notches that are within a frequency range of 5 kHz-10 kHz. This may be significant because notches in this frequency range tend to vary between different users. This means that, at a frequency range of approximately 5 kHz-10 kHz, notch number, notch size, notch location, may have strong effects regarding how acoustic energy is received at the entry of the ear canal (and thus can affect user perception). Thus, having a template HRTF as smooth and continuous function with no notches at this frequency range of approximately 5 kHz-10 kHz makes it a suitable template that can then be individualized for different users. In some embodiments, the template HRTF generating module 430 generate an HRTF template to be a smooth and continuous function lacking notches at all frequency ranges. In some embodiments, template HRTF generating module 430 generates an HRTF that is smooth and continuous function over one or more bands of frequencies, but may include notches outside of these one or more bands of frequencies. For example, the template HRTF generating module 430 may generate a template HRTF template that lacks notches over a frequency range (e.g., approximately 5 kHz-10 kHz), but may include one or more notches outside of this range.

Note that the generic HRTF used to generate the template HRTF is based on a population of users. In some embodiments, the population may be selected such that it is representative of most users, and a single template HRTF is generated from the population and is used to generate all some or all individualized HRTFs.

In other embodiments, multiple populations are used to generate different generic HRTFs, and the populations are such that each are associated with one or more common characteristics. The characteristics may be, e.g., head size, head shape, ear size, ear shape, age, gender, some other feature that affects how a person perceives sound, or some combination thereof. For example, one population may be for adults, one population for children, one population for men, one population for women, etc. The template HRTF generating module 430 may generate a template HRTF for one or more of the plurality of generic HRTFs. Accordingly, there may be a plurality of different template HRTFs, and each template HRTF is directed to different groups that share some common set of characteristics.

In some embodiments, the template HRTF generating module 430 may periodically generate a new template HRTF and/or modify a previously generated template HRTF as more population HRTF data is obtained. The template HRTF generating module 430 may store each newly generated template HRTF and/or each update to a template HRTF in the data store 410. In some embodiments, the server 400 may send a newly generated template HRTF and/or an update to a template HRTF to the headset.

The HRTF individualization module 430 determines filters that are individualized to the user based at least in part on acoustic features data associated with a user. The filters may include, e.g., one or more filter parameter values that are individualized to the user. The HRTF individualization module 430 employs a trained machine learning (ML) model on the acoustic features data of a user to determine individualized filter parameter values (e.g., filter parameter values) for one or more individualized filters (e.g., notches) that are customized to the user. In some embodiments, the individualized filter parameter values are parameterized by sound source elevation and azimuth angles. The ML model is first trained using data collected from a population of users. The collected data may include, e.g., image data, anthropometric features, and acoustic data. The training may include supervised or unsupervised learning algorithms including, but not limited to, linear and/or logistic regression models, neural networks, classification and regression trees, k-means clustering, vector quantization, or any other machine learning algorithms. The acoustic data may include HRTFs measured using audio measurement apparatus and/or simulated via numerical analysis from three dimensional scans of a head.

In some embodiments, the filters and/or filter parameter values are derived via machine learning directly from image data of a user correspond to single or multiple snapshots of left and right ears taken by a camera (in phone or otherwise). In some embodiments, the filters and/or filter parameter values are derived via machine learning from single or multiple videos of left and right ear captured by a camera (in phone or otherwise). In some embodiments, the filters and/or filter parameter values are derived from anthropometric features of a user and correspond to physical characteristics of the left and right ear. These anthropometric features include the height of the left and right ear, the width of left and right ear, left and right ear cavum concha height, left and right ear cavum concha width, left and right ear cymba height, left and right ear fossa height, left and right ear pinna height and width, left and right ear intertragal incisure width and other related physical measurements. In some embodiments the filters and/or filter parameter values are derived from weighted combinations of photos, video, and anthropometric measurements.

In some embodiments, the ML model uses a convolutional neural network model with layers of nodes, in which values at nodes of a current layer are a transformation of values at nodes of a previous layer. A transformation in the model is determined through a set of weights and parameters connecting the current layer and the previous layer. In some examples, the transformation may also be determined through a set of weights and parameters used to transform between previous layers in the model.

The input to the neural network model may be some or all of the acoustic features data of a user along with a template HRTF encoded onto the first convolutional layer, and the output of the neural network model is filter parameter values for one or more individualized notches to be applied to the template HRTF as parameterized by elevation and azimuth angles for the user; this is decoded from the output layer of the neural network. The weights and parameters for the transformations across the multiple layers of the neural network model may indicate relationships between information contained in the starting layer and the information obtained from the final output layer. For example, the weights and parameters can be a quantization of user characteristics, etc. included in information in the user image data. The weights and parameters may also be based on historical user data.

The ML model can include any number of machine learning algorithms. Some other ML models that can be employed are linear and/or logistic regression, classification and regression trees, k-means clustering, vector quantization, etc. In some embodiments, the ML model includes deterministic methods that have been trained with reinforcement learning (thereby creating a reinforcement learning model). The model is trained to increase the quality of the individualized sets of filter parameter values generated using measurements from a monitoring system within the audio system at the headset.

The HRTF individualization module 430 selects an HRTF template for use in generating one or more individualized HRTFS for the user. In some embodiments, the HRTF individualization module 430 simply retrieves the single HRTF template (e.g., from the data store 410). In other embodiments, the HRTF individualization module 430 determines one or more characteristics associated with the user from the acoustic features data, and uses the determined one or more characteristics to select a template HRTF from a plurality of template HRTFs.

The HRTF individualization module 430 generates one or more individualized HRTFs for a user using the selected template HRTF and one or more of the individualized filters (e.g., sets of filter parameter values). The HRTF individualization module 430 applies the individualized filters (e.g., one or more individualized sets of filter parameter values) to the selected template HRTF to form an individualized HRTF. In some embodiments, the HRTF individualization module 430 adds at least one notch to the selected template HRTF using at least one of the one or more individualized filters to generate an individualized HRTF. In this manner, the HRTF individualization module 430 is able to approximate a true HRTF (e.g., as described above with regard to FIG. 2.) by adding one or more notches (that are individualized to the user) to the template HRTF. In some embodiments, the HRTF individualization module 430 may then provide (via the communication module 420) the one or more individualized HRTFs to the headset. In alternate embodiments, the HRTF individualization module 430 provides the individualize sets of filter parameter values to the headset, and the headset generates the one or the one or more individualized HRTFs using a template HRTF.

Figure 5:
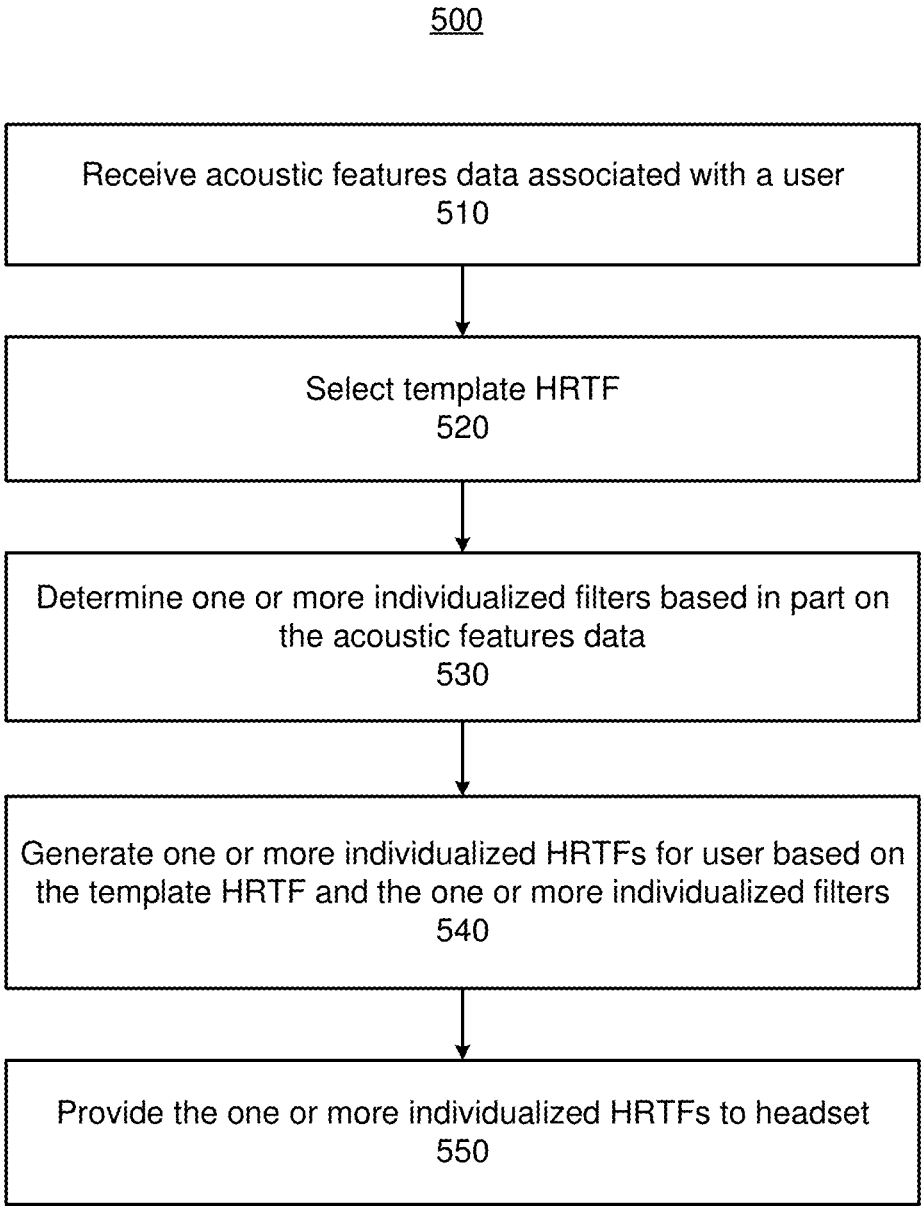
FIG. 5 is a flowchart illustrating a process for processing a request for one or more individualized HRTFs for a user, in accordance with one or more embodiments.

FIG. 5 is a flowchart illustrating a process 500 for processing a request for one or more individualized HRTFs for a user, in accordance with one or more embodiments. In one embodiment, the process of FIG. 5 is performed by a server (e.g., the server 400). Other entities may perform some or all of the steps of the process in other embodiments (e.g., a console). Likewise, embodiments may include different and/or additional steps, or perform the steps in different orders.

The server 400 receives 510 acoustic feature data associated with a user. For example, the server 400 may receive one or more images of a head and/or ears of the user. The acoustic feature data may be provided to the server over a network from, e.g., an imaging device, a mobile device, a headset, etc.

The server 400 selects 520 a template HRTF. The server 400 selects a template HRTF from one or more templates (e.g., stored in a data store). In some embodiments, the server 400 selects the template HRTF based in part on the acoustic feature data associated with the user. For example, the server 400 may determine that the user is an adult using the acoustic feature data and select a template HRTF that is associated with children (v. adults).

The server 500 determines 530 one or more individualized filters based in part on the acoustic features data. The determination is performed using a trained machine learning model. In some embodiments, at least one of the individualized filters describe one or more sets of filter parameter values. Each set of filter parameter values describes a single notch. The individualized filter parameter values describe a frequency location, a width of a frequency band centered around the frequency location (e.g., determined by a Quality factor and/or Filter Order), and depth at the frequency location (e.g., gain). In some embodiments, individualized filter parameter values are parameterized for each elevation and azimuth angle pair values in a spherical coordinate system centered around the user. In some embodiments, the individualized filter parameter values are described for within one or more specific frequency ranges (e.g., 5 kHz-10 kHz).

The server 500 generates 540 one or more individualized HRTFs for the user based on the template HRTF and the one or more individualized filters (e.g., one or more sets of filter parameter values). The server 500 adds at least one notch, using of the one or more individualized filters (e.g., via one or more sets of filter parameter values), to the template HRTF to generate an individualized HRTF.

The server 500 provides 550 the one or more individualized HRTFs to an audio system associated with the user. In some embodiments, some or all of the audio system may be part of a headset. In other embodiments, some or all of the audio system may be separate to and external to a headset. The one or more individualized HRTFs may be used by the audio system to render audio content to the user.

Note, in alternate embodiments, the server 500 provides the one or more individualized filters (and possibly the template HRTF) to the headset, and step 540 is performed by the headset.

Figure 6:
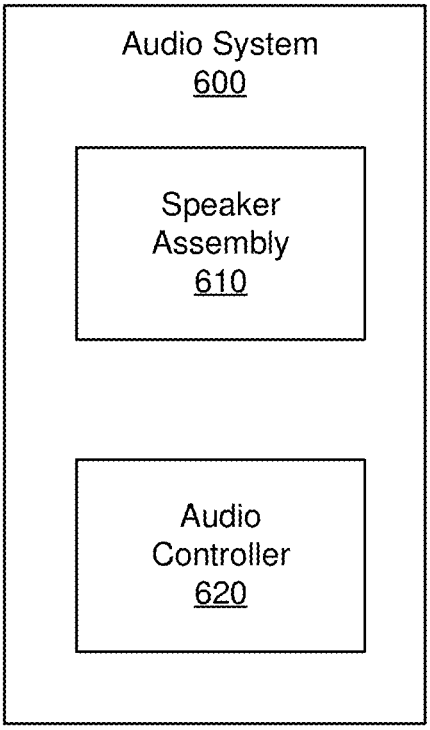
FIG. 6 is a block diagram of an audio system, in accordance with one or more embodiments.

FIG. 6 is a block diagram of an audio system 600, in accordance with one or more embodiments. In some embodiments, the audio system of FIG. 6 is a component of a headset providing audio content to the user. In other embodiments, some or all of the audio system is 600 is separate to and external to a headset. For example, the audio system 600 may be part of a console. The audio system 600 includes a speaker assembly 610 an audio controller 620. Some embodiments of the audio system 600 have different components than those described here. Similarly, the functions can be distributed among the components in a different manner than is described here.

The speaker assembly 610 provides audio content to a user of the audio system 600. The speaker assembly 610 includes speakers that provide the audio content in accordance with instructions from the audio controller 620. In some embodiments, one or more speakers of the speaker assembly 610 may be located remote from the headset (e.g., within a local area of the headset). The speaker assembly 610 is configured to provide audio content to one or both ears of a user of the audio system 600 with the speakers. A speaker may be, e.g., a moving coil transducer, a piezoelectric transducer, some other device that generates an acoustic pressure wave using an electric signal, or some combination thereof. A typical moving coil transducer includes a coil of wire and a permanent magnet to produce a permanent magnetic field. Applying a current to the wire while it is placed in the permanent magnetic field produces a force on the coil based on the amplitude and the polarity of the current that can move the coil towards or away from the permanent magnet. The piezoelectric transducer comprises a piezoelectric material that can be strained by applying an electric field or a voltage across the piezoelectric material. Some examples of piezoelectric materials include a polymer (e.g., polyvinyl chloride (PVC), polyvinylidene fluoride (PVDF)), a polymer-based composite, ceramic, or crystal (e.g., quartz (silicon dioxide or SiO2), lead zirconate-titanate (PZT)). One or more speakers placed in proximity to the ear of the user may be coupled to a soft material (e.g., silicone) that attaches well to an ear of a user and that may be comfortable for the user.

The audio controller 620 controls operation of the audio system 600. In some embodiments, the audio controller 620 obtains acoustic features data associated with a user of the headset. The acoustic features data may be obtained from an imaging device (e.g., a depth camera assembly) on the headset, or from some other device (e.g., a smart phone). In some embodiments, the audio controller 620 may be configured to determine anthropometric features based on data from the imaging device and/or other device. For example, the audio controller 620 may derive the anthropometric features using weighted combinations of photos, video, and anthropometric measurements. In some embodiments, the audio controller 620 provides acoustic features data to a server (e.g., the server 400) via a network (e.g., the network 340).

The audio system 600 generates audio content using one or more individualized HRTFs. The one or more individualized HRTFs are customized to the user. In some embodiments, some or all of the one or more individualized HRTFs are received from the server. In some embodiments, the audio controller 620 generates the one or more individualized HRTFS using data (e.g., individualized sets of notch parameters and a template HRTF) received from the server.

In some embodiments, the audio controller 620 may identify an opportunity to present audio content with a target sound source direction to the user of the audio system 600, e.g., when a flag in a virtual experience comes up for presenting audio content with a target sound source direction. The audio controller 620 may first retrieve audio data that will be subsequently rendered to generate the audio content for presentation to the user. Audio data may additionally specify a target sound source direction and/or a target location of a virtual source of the audio content within a local area of the audio system 600. Each target sound source direction describes spatial direction of virtual source for the sound. In addition, a target sound source location is a spatial position of the virtual source. For example, audio data may include an explosion coming from a first target sound source direction and/or target location behind the user, and a bird chirping coming from a second target sound source direction and/or target location in front of the user. In some embodiments, the target sound source directions and/or target locations may be organized in a spherical coordinate system with the user at an origin of the spherical coordinate system. Each target sound source direction is then denoted as an elevation angle from a horizon plane and an azimuthal angle in the spherical coordinate system, as depicted in FIG. 1. A target sound source location includes an elevation angle from the horizon plane, an azimuthal angle, and a distance from the origin in the spherical coordinate system.

The audio controller 620 uses one or more of the individualized HRTFs for the user based on the target audio source direction and/or location perception associated with an audio data to be presented to the user. The audio controller 620 convolves the audio data with the one or more individualized HRTFs to render audio content that is spatialized to appear to originate from the target source direction and/or location to the user. The audio controller 620 provides the rendered audio content to the speaker assembly 610 for presentation to a user of the audio system.

Figure 7:
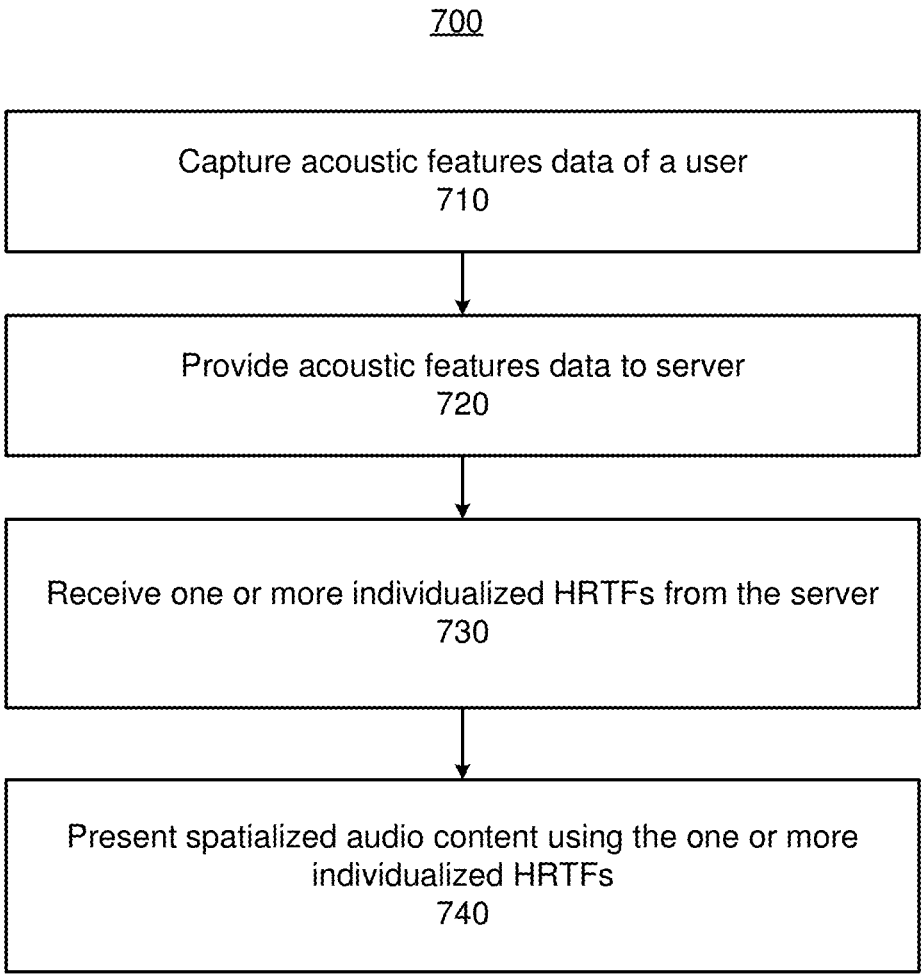
FIG. 7 is a flowchart illustrating a process for presenting audio content on a headset using one or more individualized HRTFs, in accordance with one or more embodiments.

FIG. 7 is a flowchart illustrating a process 700 for presenting audio content on a headset using one or more individualized HRTFs, in accordance with one or more embodiments. In one embodiment, the process of FIG. 7 is performed by a headset. Other entities may perform some or all of the steps of the process in other embodiments. For example, steps 710 and 720 may be performed by some other device. Likewise, embodiments may include different and/or additional steps, or perform the steps in different orders.

The headset captures 710 acoustic features data of a user. The headset may, e.g., capture images and/or video of the user's head and ears using an imaging device in the headset. In some embodiments, the headset may communicate with an external device (e.g., camera, mobile device/phone, etc.) to receive the acoustic features data.

The headset provides 720 the acoustic features data to a server (e.g., the server system 400). In some embodiments, the acoustic features data may be pre-processed at the headset before being provided to the server. For example, in some embodiments, the headset may use captured images and/or video to determine anthropometric features of the user.

The headset receives 730 one or more individualized HRTFs from the server. The one or more individualized HRTFs are customized to the user.

The headset presents 740 audio content using the one or more individualized HRTFs. The headset may convolve audio data with the one or more individualized HRTFs to generate audio content. The audio content is rendered by a speaker assembly, and is perceived to originate from a target source direction and/or target location.

In the above embodiments, the server provides the individualized HRTFs to the headset. However, in alternate embodiments, the server may provide to the headset a template HRTF, one or more individualized filters (e.g., one or more sets of individualized filter parameter values), or some combination thereof. And the headset would then generate the individualized HRTFs using the one or more individualized filters.

Artificial Reality System Environment

Figure 8:
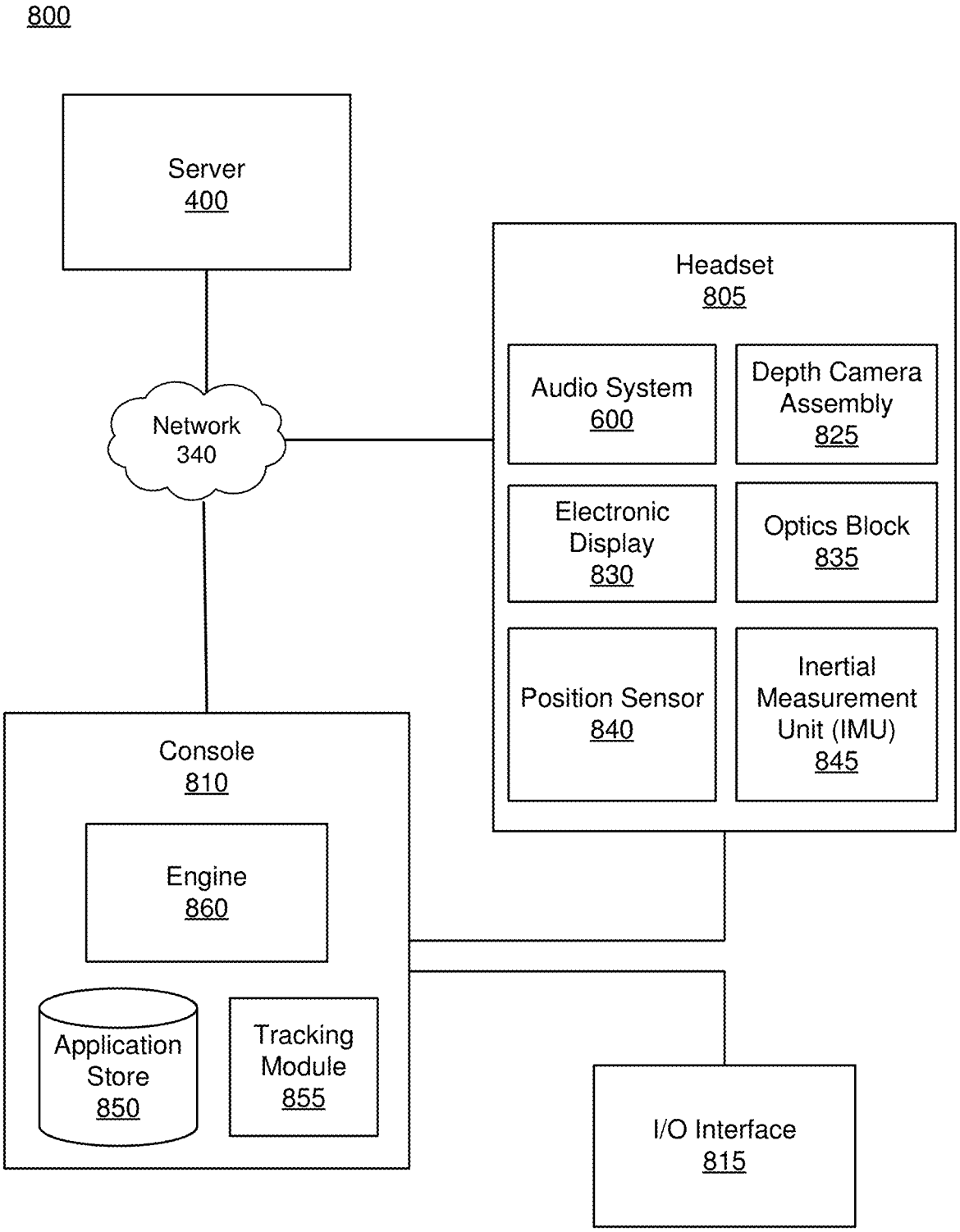
FIG. 8 is a system environment for a headset including an audio system, in accordance with one or more embodiments.

FIG. 8 is a system environment 800 for a headset 805 including the audio system 600, in accordance with one or more embodiments. The system 800 may operate in an artificial reality environment, e.g., a virtual reality, an augmented reality, a mixed reality environment, or some combination thereof. The system 800 shown by FIG. 8 comprises the headset 805 and an input/output (I/O) interface 815 that is coupled to a console 810, and the console 810 and/or the headset 805 communicate with the server 400 over the network 340. The headset 805 may be an embodiment of the headset 320. While FIG. 8 shows an example system 800 including one headset 805 and one I/O interface 815, in other embodiments, any number of these components may be included in the system 800. For example, there may be multiple headsets 805 each having an associated I/O interface 815 with each headset 805 and I/O interface 815 communicating with the console 810. In alternative configurations, different and/or additional components may be included in the system 800. Additionally, functionality described in conjunction with one or more of the components shown in FIG. 8 may be distributed among the components in a different manner than described in conjunction with FIG. 8 in some embodiments. For example, some or all of the functionality of the console 810 is provided by the headset 805.

The headset 805 may be a near-eye display (NED) or a head-mounted display (HMD) that presents content to a wearer comprising augmented views of a physical, real-world environment with computer-generated elements (e.g., two dimensional (2D) or three dimensional (3D) images, 2D or 3D video, sound, etc.). In some embodiments, the presented content includes audio that is presented via the audio system 600 that receives audio information from the headset 805, the console 810, or both, and presents audio data based on the audio information. In some embodiments, the headset 805 presents virtual content to the wearer that is based in part on a real environment surrounding the wearer. For example, virtual content may be presented to a wearer of the headset. The headset includes an audio system 600. The headset 805 may also include a depth camera assembly (DCA) 825, an electronic display 830, an optics block 835, one or more position sensors 840, and an inertial measurement Unit (IMU) 845. Some embodiments of the headset 805 have different components than those described in conjunction with FIG. 8. Additionally, the functionality provided by various components described in conjunction with FIG. 8 may be differently distributed among the components of the headset 805 in other embodiments, or be captured in separate assemblies remote from the headset 805. An example, headset is described below with regard to FIG. 9.

The audio system 600 presents audio content to a user of the headset 805 using one or more individualized HRTFs. In some embodiments, the audio system 600 may receive (e.g., from the server 400 and/or the console 810) and store individualized HRTFs for a user. In some embodiments the audio system 600 may receive (e.g., from the server 400 and/or the console 810) and store a template HRTF and/or one or more individualized filters (e.g., described via parameter values) to be applied to the template HRTF. The audio system 600 receives audio data that is associated with a target sound source direction with respect to the headset 805. The audio system 600 applies the one or more individualized HRTFs to the audio data to generate audio content. The audio system 600 presents the audio content to the user via a speaker assembly. The presented audio content is spatialized such that it appears to be originating from the target sound source direction and/or target location when presented speaker assembly.

The DCA 825 captures data describing depth information of a local area surrounding some or all of the headset 805. The DCA 825 may include a light generator, an imaging device, and a DCA controller that may be coupled to both the light generator and the imaging device. The light generator illuminates a local area with illumination light, e.g., in accordance with emission instructions generated by the DCA controller. The DCA controller is configured to control, based on the emission instructions, operation of certain components of the light generator, e.g., to adjust an intensity and a pattern of the illumination light illuminating the local area. In some embodiments, the illumination light may include a structured light pattern, e.g., dot pattern, line pattern, etc. The imaging device captures one or more images of one or more objects in the local area illuminated with the illumination light. The DCA 825 can compute the depth information using the data captured by the imaging device or the DCA 825 can send this information to another device such as the console 810 that can determine the depth information using the data from the DCA 825. The DCA 825 may also be used to capture depth information describing a user's head and/or ears by taking the headset off and pointing the DCA at the user's head and/or ears.

The electronic display 830 displays 2D or 3D images to the wearer in accordance with data received from the console 810. In various embodiments, the electronic display 830 comprises a single electronic display or multiple electronic displays (e.g., a display for each eye of a wearer). Examples of the electronic display 830 include: a liquid crystal display (LCD), an organic light emitting diode (OLED) display, an active-matrix organic light-emitting diode display (AMOLED), a waveguide display, some other display, or some combination thereof.

The optics block 835 magnifies image light received from the electronic display 830, corrects optical errors associated with the image light, and presents the corrected image light to a wearer of the headset 805. In various embodiments, the optics block 835 includes one or more optical elements. Example optical elements included in the optics block 835 include: a waveguide, an aperture, a Fresnel lens, a convex lens, a concave lens, a filter, a reflecting surface, or any other suitable optical element that affects image light. Moreover, the optics block 835 may include combinations of different optical elements. In some embodiments, one or more of the optical elements in the optics block 835 may have one or more coatings, such as partially reflective or anti-reflective coatings.

Magnification and focusing of the image light by the optics block 835 allows the electronic display 830 to be physically smaller, weigh less, and consume less power than larger displays. Additionally, magnification may increase the field of view of the content presented by the electronic display 830. For example, the field of view of the displayed content is such that the displayed content is presented using almost all (e.g., approximately 110 degrees diagonal), and in some cases all, of the wearer's field of view. Additionally, in some embodiments, the amount of magnification may be adjusted by adding or removing optical elements.

In some embodiments, the optics block 835 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 830 for display is predistorted, and the optics block 835 corrects the distortion when it receives image light from the electronic display 830 generated based on the content.

The IMU 845 is an electronic device that generates data indicating a position of the headset 805 based on measurement signals received from one or more of the position sensors 840. A position sensor 840 generates one or more measurement signals in response to motion of the headset 805. Examples of position sensors 840 include: one or more accelerometers, one or more gyroscopes, one or more magnetometers, another suitable type of sensor that detects motion, a type of sensor used for error correction of the IMU 845, or some combination thereof. The position sensors 840 may be located external to the IMU 845, internal to the IMU 845, or some combination thereof.

Based on the one or more measurement signals from one or more position sensors 840, the IMU 845 generates data indicating an estimated current position of the headset 805 relative to an initial position of the headset 805. For example, the position sensors 840 include multiple accelerometers to measure translational motion (forward/back, up/down, left/right) and multiple gyroscopes to measure rotational motion (e.g., pitch, yaw, and roll). In some embodiments, the IMU 845 rapidly samples the measurement signals and calculates the estimated current position of the headset 805 from the sampled data. For example, the IMU 845 integrates the measurement signals received from the accelerometers over time to estimate a velocity vector and integrates the velocity vector over time to determine an estimated current position of a reference point on the headset 805. Alternatively, the IMU 845 provides the sampled measurement signals to the console 810, which interprets the data to reduce error. The reference point is a point that may be used to describe the position of the headset 805. The reference point may generally be defined as a point in space or a position related to the headset's 805 orientation and position.

The I/O interface 815 is a device that allows a wearer to send action requests and receive responses from the console 810. An action request is a request to perform a particular action. For example, an action request may be an instruction to start or end capture of image or video data, or an instruction to perform a particular action within an application. The I/O interface 815 may include one or more input devices. Example input devices include: a keyboard, a mouse, a game controller, or any other suitable device for receiving action requests and communicating the action requests to the console 810. An action request received by the I/O interface 815 is communicated to the console 810, which performs an action corresponding to the action request. In some embodiments, the I/O interface 815 includes an IMU 845, as further described above, that captures calibration data indicating an estimated position of the I/O interface 815 relative to an initial position of the I/O interface 815. In some embodiments, the I/O interface 815 may provide haptic feedback to the wearer in accordance with instructions received from the console 810. For example, haptic feedback is provided when an action request is received, or the console 810 communicates instructions to the I/O interface 815 causing the I/O interface 815 to generate haptic feedback when the console 810 performs an action.

The console 810 provides content to the headset 805 for processing in accordance with information received from one or more of: the headset 805 and the I/O interface 815. In the example shown in FIG. 8, the console 810 includes an application store 850, a tracking module 855 and an engine 860. Some embodiments of the console 810 have different modules or components than those described in conjunction with FIG. 8. Similarly, the functions further described below may be distributed among components of the console 810 in a different manner than described in conjunction with FIG. 8.

The application store 850 stores one or more applications for execution by the console 810. An application is a group of instructions, that when executed by a processor, generates content for presentation to the wearer. Content generated by an application may be in response to inputs received from the wearer via movement of the headset 805 or the I/O interface 815. Examples of applications include: gaming applications, conferencing applications, video playback applications, or other suitable applications.

The tracking module 855 calibrates the system environment 800 using one or more calibration parameters and may adjust one or more calibration parameters to reduce error in determination of the position of the headset 805 or of the I/O interface 815. Calibration performed by the tracking module 855 also accounts for information received from the IMU 845 in the headset 805 and/or an IMU 845 included in the I/O interface 815. Additionally, if tracking of the headset 805 is lost, the tracking module 855 may re-calibrate some or all of the system environment 800.

The tracking module 855 tracks movements of the headset 805 or of the I/O interface 815 using information from the one or more position sensors 840, the IMU 845, the DCA 825, or some combination thereof. For example, the tracking module 855 determines a position of a reference point of the headset 805 in a mapping of a local area based on information from the headset 805. The tracking module 855 may also determine positions of the reference point of the headset 805 or a reference point of the I/O interface 815 using data indicating a position of the headset 805 from the IMU 845 or using data indicating a position of the I/O interface 815 from an IMU 845 included in the I/O interface 815, respectively. Additionally, in some embodiments, the tracking module 855 may use portions of data indicating a position or the headset 805 from the IMU 845 to predict a future location of the headset 805. The tracking module 855 provides the estimated or predicted future position of the headset 805 or the I/O interface 815 to the engine 860.

The engine 860 also executes applications within the system environment 800 and receives position information, acceleration information, velocity information, predicted future positions, or some combination thereof, of the headset 805 from the tracking module 855. Based on the received information, the engine 860 determines content to provide to the headset 805 for presentation to the wearer. For example, if the received information indicates that the wearer has looked to the left, the engine 860 generates content for the headset 805 that mirrors the wearer's movement in a virtual environment or in an environment augmenting the local area with additional content. Additionally, the engine 860 performs an action within an application executing on the console 810 in response to an action request received from the I/O interface 815 and provides feedback to the wearer that the action was performed. The provided feedback may be visual or audible feedback via the headset 805 or haptic feedback via the I/O interface 815.

Example Headset

Figure 9:
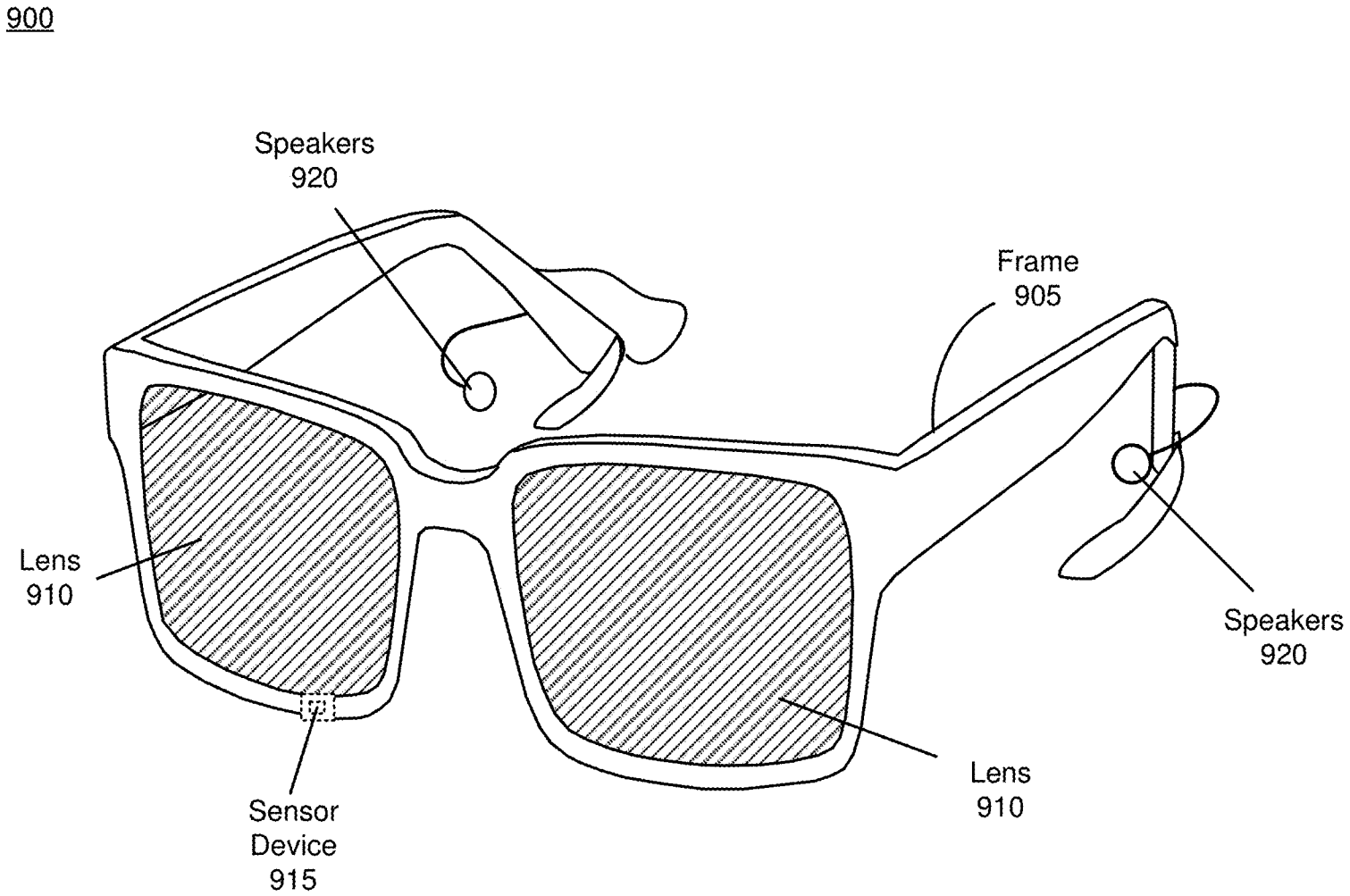
FIG. 9 is a perspective view of a headset including an audio system, in accordance with one or more embodiments.

FIG. 9 is a perspective view of a headset 900 including an audio system, in accordance with one or more embodiments. The headset 900 presents media to a user. Examples of media presented by the headset 900 include one or more images, video, audio, or some combination thereof. The headset 900 may be a near-eye display, eye glasses, or a head-mounted display (HMD). The headset 900 includes, among other components, a frame 905, a lens 910, a sensor device 915, and an audio system (not shown). In embodiments as a headset, the headset 900 may correct or enhance the vision of a user, protect the eye of a user, or provide images to a user. The headset 900 may be eyeglasses which correct for defects in a user's eyesight. The headset 900 may be sunglasses which protect a user's eye from the sun. The headset 900 may be safety glasses which protect a user's eye from impact. The headset 900 may be a night vision device or infrared goggles to enhance a user's vision at night. In alternative embodiments, the headset 900 may not include a lens 910 and may be a frame 905 with the audio system that provides audio content (e.g., music, radio, podcasts) to a user.

The frame 905 includes a front part that holds the lens 910 and end pieces to attach to the user. The front part of the frame 905 bridges the top of a nose of the user. The end pieces (e.g., temples) are portions of the frame 905 to which the temples of a user are attached. The length of the end piece may be adjustable (e.g., adjustable temple length) to fit different users. The end piece may also include a portion that curls behind the ear of the user (e.g., temple tip, ear piece).

The lens 910 provides or transmits light to a user wearing the headset 900. The lens 910 is held by a front part of the frame 905 of the headset 900. The lens 910 may be prescription lens (e.g., single vision, bifocal and trifocal, or progressive) to help correct for defects in a user's eyesight. The prescription lens transmits ambient light to the user wearing the headset 900. The transmitted ambient light may be altered by the prescription lens to correct for defects in the user's eyesight. The lens 910 may be a polarized lens or a tinted lens to protect the user's eye from the sun. The lens 910 may be one or more waveguides as part of a waveguide display in which image light is coupled through an end or edge of the waveguide to the eye of the user. The lens 910 may include an electronic display for providing image light and may also include an optics block for magnifying image light from the electronic display. In some embodiments the lens 910 is an embodiment of the electronic display 830.

The sensor device 915 estimates a current position of the headset 900 relative to an initial position of the headset 900. The sensor device 915 may be located on a portion of the frame 905 of the headset 900. The sensor device 915 includes a position sensor and an inertial measurement unit. The sensor device 915 may also include one or more cameras placed on the frame 905 in view or facing the user's eyes. The one or more cameras of the sensor device 915 are configured to capture image data corresponding to eye positions of the user's eyes. The sensor device 915 may be an embodiment of the IMU 845 and/or position sensor 840.

The audio system (not shown) provides audio content to a user of the headset 900. The audio system is an embodiment of the audio system 600, and presents content using the speakers 920.

Additional Configuration Information

Embodiments according to the invention are in particular disclosed in the attached claims directed to methods, a storage medium, and an audio system, wherein any feature mentioned in one claim category, e.g. method, can be claimed in another claim category, e.g. storage medium, audio system, system, and computer program product, as well. The dependencies or references back in the attached claims are chosen for formal reasons only. However any subject matter resulting from a deliberate reference back to any previous claims (in particular multiple dependencies) can be claimed as well, so that any combination of claims and the features thereof is disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

In an embodiment, a method may comprise: determining one or more individualized filters based at least in part on acoustic features data of a user; generating one or more individualized head-related transfer functions (HRTFs) for the user based on a template HRTF and the determined one or more individualized filters; and providing the generated one or more individualized HRTFs to an audio system, wherein an individualized HRTF is used to generate spatialized audio content.

Determining the one or more individualized filters may comprise using a trained machine learning model with the acoustic features data of the user to determine parameter values for the one or more individualized filters. The parameter values for the one or more individualized filters may describe one or more individualized notches in the one or more individualized HRTFs. The parameter values may comprise: a frequency location, a width in a frequency band centered at the frequency location, and an amount of attenuation caused in the frequency band centered at the frequency location.

The machine learning model may be trained with image data, anthropometric features, and acoustic data including measurements of HRTFs obtained for a population of users.

Generating the one or more individualized HRTFs for the user may be based on the template HRTF and the determined one or more individualized filters may comprise: adding at least one notch to the template HRTF using at least one of the one or more individualized filters to generate an individualized HRTF of the one or more individualized HRTFs.

The template HRTF may be based on a generic HRTF describing a population of users, the generic HRTF may include at least one notch over a range of frequencies. The template HRTF may be generated from the generic HRTF by removing the at least one notch such that it is a smooth and continuous function over the range of frequencies. The range of frequencies may be 5 kHz to 10 kHz. A least one notch may be present in the template HRTF outside the range of frequencies.

The audio system may be part of a headset. The audio system may be separate from and external to a headset.

In an embodiment, a non-transitory computer readable medium may be configured to store program code instructions, when executed by a processor, may cause the processor to perform steps comprising: determining one or more individualized filters based at least in part on acoustic features data of a user; generating one or more individualized head-related transfer functions (HRTFs) for the user based on a template HRTF and the determined one or more individualized filters; and providing the generated one or more individualized HRTFs to an audio system, wherein an individualized HRTF is used to generate spatialized audio content.

Determining the one or more individualized filters may comprise using a trained machine learning model with the acoustic features data of the user to determine parameter values for the one or more individualized filters.

The parameter values for the one or more individualized filters may describe one or more individualized notches in the one or more individualized HRTFs. The parameter values may comprise: a frequency location, a width in a frequency band centered at the frequency location, and an amount of attenuation caused in the frequency band centered at the frequency location.

The machine learning model may be trained with image data, anthropometric features, and acoustic data including measurements of HRTFs obtained for a population of users.

Generating the one or more individualized HRTFs for the user may be based on the template HRTF and the determined one or more individualized filters may comprise: adding at least one notch to the template HRTF using at least one of the one or more individualized filters to generate an individualized HRTF of the one or more individualized HRTFs.

In an embodiment, a method may comprise: receiving, at a headset, one or more individualized HRTFs for a user of the headset; retrieving audio data associated with a target sound source direction with respect to the headset; applying the one or more individualized HRTFs to the audio data to render the audio data as audio content; and presenting, by a speaker assembly of the headset, the audio content, wherein the presented audio content is spatialized such that it appears to be originating from the target sound source direction.

In an embodiment, a method may comprise: capturing acoustic features data of the user; and transmitting the captured acoustic features data to a server, wherein the server uses the captured acoustic features data to determine the one or more individualized HRTFs, and the server provides the one or more individualized HRTFs to the headset.

In an embodiment an audio system may comprise: an audio assembly comprising one or more speakers configured to present audio content to a user of the audio system; and an audio controller configured to perform a method according to or within any of the above mentioned embodiments.

In an embodiment, one or more computer-readable non-transitory storage media may embody software that is operable when executed to perform a method according to or within any of the above mentioned embodiments.

In an embodiment, an audio system and/or system may comprise: one or more processors; and at least one memory coupled to the processors and comprising instructions executable by the processors, the processors operable when executing the instructions to perform a method according to or within any of the above mentioned embodiments.

In an embodiment, a computer program product, preferably comprising a computer-readable non-transitory storage media, may be operable when executed on a data processing system to perform a method according to or within any of the above mentioned embodiments.

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability. Embodiments of the disclosure may also relate to a product that is produced by a computing process described herein. Such a product may comprise information resulting from a computing process, where the information is stored on a non transitory, tangible computer readable storage medium and may include any embodiment of a computer program product or other data combination described herein. Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

determining one or more individualized filters based at least in part on acoustic features data of a user;

applying the one or more individualized filters to a template head-related transfer function (HRTF) to modify the template HRTF to form one or more individualized HRTFs, wherein each of the one or more individualized HRTFs are versions of the template HRTF that are customized to the user, the template HRTF comprising a smoothly varying function that does not exhibit frequency characteristics individualized to the user over a first frequency band, and at least one of the one or more individualized HRTFs includes a frequency characteristic individualized to the user within the first frequency band; and providing the generated one or more individualized HRTFs to an audio system, wherein an individualized HRTF is used to generate spatialized audio content.

2. The method of claim 1, wherein determining the one or more individualized filters comprises using a trained machine learning model with the acoustic features data of the user to determine parameter values for the one or more individualized filters.

3. The method of claim 2, wherein the parameter values for the one or more individualized filters describe one or more individualized notches in the one or more individualized HRTFs.

4. The method of claim 3, wherein the parameter values comprise: a frequency location, a width in a frequency band centered at the frequency location, and an amount of attenuation caused in the frequency band centered at the frequency location.

5. The method of claim 2, wherein the machine learning model is trained with image data, anthropometric features, and acoustic data including measurements of HRTFs obtained for a population of users.

6. The method of claim 1, wherein applying the one or more individualized filters to the template HRTF to modify the template HRTF and form the one or more individualized HRTFs comprises:

adding at least one notch to the template HRTF using at least one of the one or more individualized filters to generate an individualized HRTF of the one or more individualized HRTFs.

7. The method of claim 1, wherein the template HRTF is based on a generic HRTF describing a population of users, the generic HRTF including at least one notch over a range of frequencies.

8. The method of claim 7, wherein the template HRTF is generated from the generic HRTF by removing the at least one notch such that it is a smooth and continuous function over the range of frequencies.

9. The method of claim 8, wherein the range of frequencies is 5 kHz to 10 kHz.

10. The method of claim 8, wherein at least one notch is present in the template HRTF outside the range of frequencies.

11. The method of claim 1, wherein the audio system is part of a headset.

12. The method of claim 1, wherein the audio system is separate from and external to a headset.

13. A non-transitory computer readable medium configured to store program code instructions, when executed by a processor, cause the processor to perform steps comprising:

determining one or more individualized filters based at least in part on acoustic features data of a user;

applying the one or more individualized filters to a template head-related transfer function (HRTF) to modify the template HRTF to form one or more individualized HRTFs, wherein each of the one or more individualized HRTFs are versions of the template HRTF that are customized to the user, the template HRTF comprising a smoothly varying function that does not exhibit frequency characteristics individualized to the user over a first frequency band, and at least one of the one or more individualized HRTFs includes a frequency characteristic individualized to the user within the first frequency band; and providing the generated one or more individualized HRTFs to an audio system, wherein an individualized HRTF is used to generate spatialized audio content.

14. The computer readable medium of claim 13, wherein determining the one or more individualized filters comprises using a trained machine learning model with the acoustic features data of the user to determine parameter values for the one or more individualized filters.

15. The computer readable medium of claim 14, wherein the parameter values for the one or more individualized filters describe one or more individualized notches in the one or more individualized HRTFs.

16. The computer readable medium of claim 15, wherein the parameter values comprise: a frequency location, a width in a frequency band centered at the frequency location, and an amount of attenuation caused in the frequency band centered at the frequency location.

17. The computer readable medium of claim 14, wherein the machine learning model is trained with image data, anthropometric features, and acoustic data including measurements of HRTFs obtained for a population of users.

18. The computer readable medium of claim 13, wherein applying the one or more individualized filters to the template HRTF to modify the template HRTF and form the one or more individualized HRTFs comprises:

adding at least one notch to the template HRTF using at least one of the one or more individualized filters to generate an individualized HRTF of the one or more individualized HRTFs.

19. A method comprising:

receiving, at a headset from a server, one or more individualized head-related transfer functions (HRTFs) for a user of the headset, the one or more individualized HRTFs generated at the server by applying one or more individualized filters to modify a template HRTF to form the one or more individualized HRTFs, wherein each of the generated one or more individualized HRTFs are versions of the template HRTF that are customized to the user, the template HRTF comprising a smoothly varying function that does not exhibit frequency characteristics individualized to the user over a first frequency band, and at least one of the one or more individualized HRTFs includes a frequency characteristic individualized to the user within the first frequency band;

retrieving audio data associated with a target sound source direction with respect to the headset;

applying the one or more individualized HRTFs to the audio data to render the audio data as audio content; and presenting, by a speaker assembly of the headset, the audio content, wherein the presented audio content is spatialized such that it appears to be originating from the target sound source direction.

20. The method of claim 19, further comprising:

capturing acoustic features data of the user; and transmitting the captured acoustic features data to the server, wherein the server uses the captured acoustic features data to determine the one or more individualized filters.

* * * * *